US006668146B2

(12) United States Patent
Folkins et al.

(10) Patent No.: US 6,668,146 B2
(45) Date of Patent: Dec. 23, 2003

(54) HYBRID SCAVENGELESS DEVELOPMENT USING DIRECT CURRENT VOLTAGE SHIFT TO REMOVE WIRE HISTORY

(75) Inventors: Jeffrey C. Folkins, Rochester, NY (US); Rasin Moser, Fairport, NY (US); William H. Wayman, Ontario, NY (US); Larry G. Hogestyn, Ontario, NY (US); Robert E. Grace, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/107,754

(22) Filed: Mar. 26, 2002

(65) Prior Publication Data

US 2003/0185598 A1 Oct. 2, 2003

(51) Int. Cl.[7] ..... G03G 15/09

(52) U.S. Cl. ..... 399/266; 399/270; 399/271

(58) Field of Search ..... 399/55, 99, 266, 399/290, 291

(56) References Cited

U.S. PATENT DOCUMENTS 4,731,633 A 3/1988 Foley et al. ..... 355/3 CH
6,049,686 A 4/2000 Folkins et al. ..... 399/266

*Primary Examiner*—Hoang Ngo
(74) *Attorney, Agent, or Firm*—Perman & Green, LLP

(57) ABSTRACT

An image transfer apparatus with the capacity to reduce or clean wire history. The cleaning is performed by supplying a voltage burst to shift, relative to nominal, the D.C. component of the electrode bias relative to the electrical bias of the donor member during the movement of the inter-imaging region through the development zone. A voltage shift may also be applied to electrically bias the donor member relative to the photoreceptor belt during the movement of the inter-imaging region through the development zone. These voltage shifts may be conducted individually or simultaneously.

25 Claims, 5 Drawing Sheets

HYBRID SCAVENGELESS DEVELOPMENT USING DIRECT CURRENT VOLTAGE SHIFT TO REMOVE WIRE HISTORY

BACKGROUND OF THE INVENTION

1. Field of the Invention

This invention relates generally to a Hybrid Scavengeless Development (HSD) apparatus for ionographic or electrophotographic imaging and printing apparatuses and machines, and more particularly is directed to a method to prevent toner or other particulate contamination of wires in such an HSD developer unit.

2. Brief Description of Related Developments

Generally, the process of electrophotographic printing includes charging a photoreceptor member to a substantially uniform potential to sensitize the surface thereof. The charged portion of the photoreceptor surface is exposed to a light image from either a scanning laser beam, an LED source, or an original document being reproduced. This records an electrostatic latent image on the photoreceptor surface. After the electrostatic latent image is recorded on the photoreceptor surface, the latent image is developed. Two-component and single-component developer materials are commonly used for development. A typical two-component developer comprises magnetic carrier granules having toner particles adhering triboelectrically thereto. A single-component developer material typically comprises toner particles. Toner particles are attracted to the latent image, forming a toner powder image on the photoreceptor surface. The toner powder image is subsequently transferred to a copy sheet. Finally, the toner powder image is heated to permanently fuse it to the copy sheet in image configuration.

Hybrid scavengeless development technology develops toner via a conventional magnetic brush onto the surface of a donor roll. A plurality of electrode wires are closely spaced from the toned donor roll in the development zone. An AC voltage is applied to the electrode wires to generate a toner cloud in the development zone. This donor roll generally consists of a conductive core covered with a thin (50–200 microns) partially conductive layer. The magnetic brush roll is held at an electrical potential difference relative to the donor roll to produce the field necessary for toner to adhere to the donor roll. The toner layer on the donor roll is then disturbed by electric fields from a wire or set of wires to produce and sustain an agitated cloud of toner particles. Typical ac voltages of the wires relative to the donor are 700–900 Vpp at frequencies of 5–15 kHz. These ac signals are often square waves, rather than pure sinusoidal waves. Toner from the cloud is then developed onto the nearby photoreceptor by fields created by a latent image.

A problem with developer systems using electrode wires is "Wire History." Wire history involves highly charged (though sometimes low charged) and generally small toner or other particles being attracted to the wire and sticking to the wire as a result of either adhesive or electrostatic attractive forces. The result is that contaminants build up on the electrodes, as a response to the image area coverage history, causing visible streaks on prints. U.S. Pat. No. 6,049,686 discloses the use of direct current (DC) offset applied to the electrode wires to reduce wire history. It is not practical to routinely work at high direct current (DC) electrode bias offsets because at the same time the offsets improve wire history they reduce the overall level of developability. The electrode DC offset being defined as the DC potential of the electrodes with respect to the magnetic roll DC level. The present invention overcomes the problems of the prior art as will be described in greater detail below.

SUMMARY OF THE INVENTION

An image transfer apparatus and a method for removing wire history from the electrodes in a Hybrid Scavengeless Development system.

One embodiment of the invention comprises an image transfer apparatus with a development unit having a development zone containing marking material; an electrode for transporting developing material positioned in the development zone; a donor member that moves in the development zone; a movable imaging member with imaging regions and inter-imaging regions between the imaging regions, the movable imaging member moving both the imaging regions and inter-imaging regions into and out of the development zone; and a voltage supply to electrically bias the electrode, the voltage supply generating a shift relative to nominal in the direct current component of the electrode bias relative to an electrical bias of the donor member during the movement of at least one of the inter-imaging regions through the development zone, wherein the electrode is cleaned.

A second embodiment of the invention comprises an image transfer apparatus, with a development unit having a development zone; a donor member for transporting marking particles to the development zone adjacent an imaging member, the imaging member, having image receiving regions and inter-image areas between the image receiving regions, the imaging member advancing the image receiving regions and the inter-image areas into and out of the development zone; and a voltage supply to electrically bias the donor member relative to the imaging member, the voltage supply generating an electrical bias shift in the donor member from a first electrical bias to a second electrical bias, the electrical bias shift being generated, during the advancement of the inter-image area through the development zone, wherein an electrode in the development zone is cleaned.

A third embodiment of the invention comprises a method of cleaning an image transfer apparatus with the steps of: providing a voltage supply; and supplying voltage from the voltage supply for electrically biasing an electrode with respect to a donor roll; and with the voltage supply, generating a shift in a direct current component of the electrical bias relative to another electrical bias of the donor roll during advancement of an inter-image area.

A fourth embodiment of the invention is a method of transferring an image, with the steps of: generating image regions on an image receiving member, the image regions being separated by inter-image areas; transporting marking particles with a development member to a development zone having an electrode positioned between the image receiving member and the development member; supplying voltage for electrically biasing the development member relative to the image receiving member; and varying at least a direct current component of the electrical bias of the development member to shift at least the direct current component from an initial voltage to another voltage during passage of the inter-image areas through the development zone.

BRIEF DESCRIPTION OF THE DRAWINGS

The foregoing aspects and other features of the present invention are explained in the following description, taken in connection with the accompanying drawings, wherein.

In as much as the art of electrophotographic printing is well known, the various processing stations employed in the printing machine will be shown hereinafter schematically and their operation described briefly with reference thereto.

DETAILED DESCRIPTION OF THE PREFERRED EMBODIMENT(S)

Figure 1:
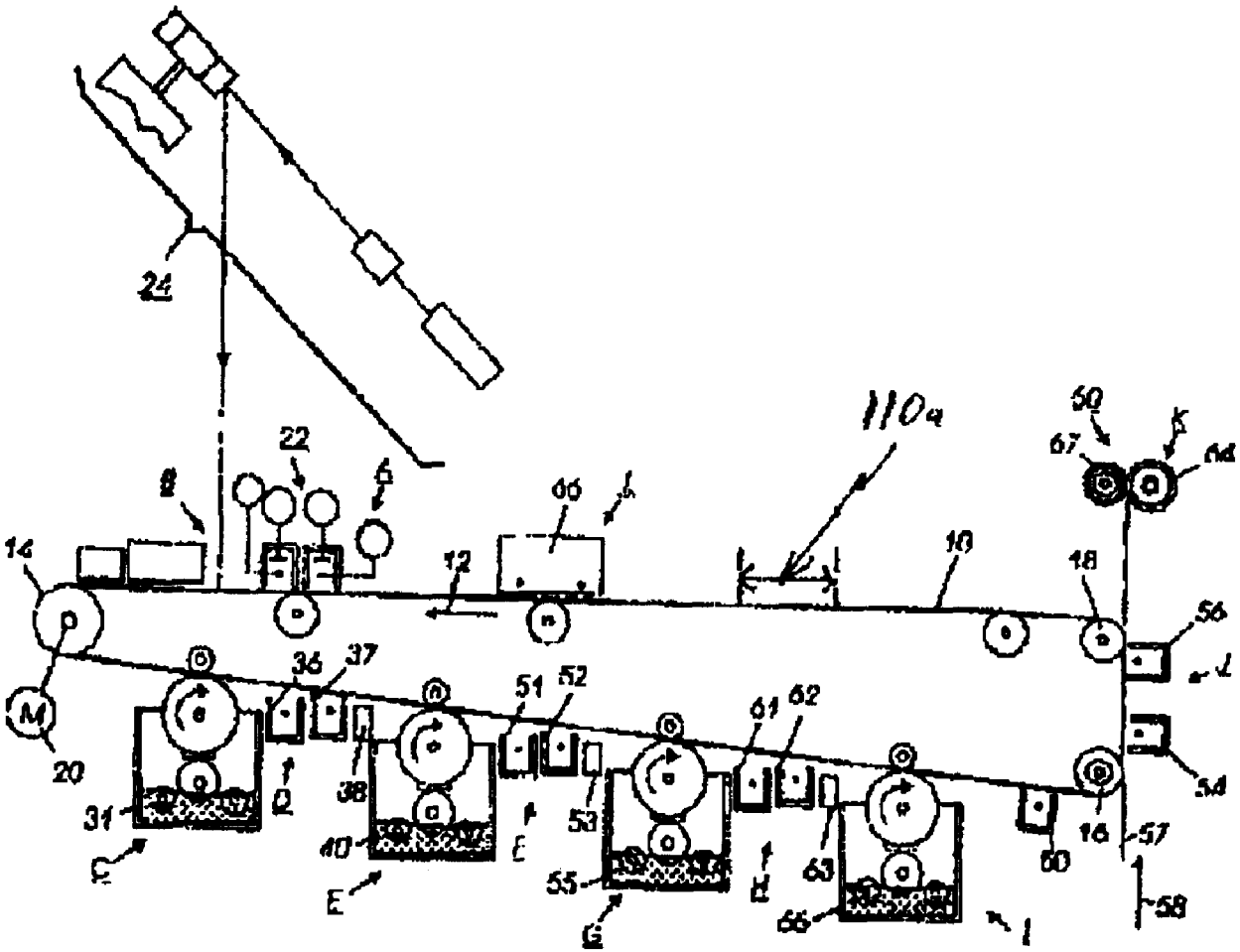
FIG. 1 is a schematic elevational view of an illustrative electrophotographic printing or imaging machine or apparatus incorporating a development apparatus having the features of the present invention therein.

Referring to FIG. 1, there is shown an illustrative electrophotographic machine having incorporated therein the development apparatus of the present invention. An electrophotographic-printing machine creates a color image in a single pass through the machine and incorporates the features of the present invention. The printing machine uses a charge retentive surface in the form of an Active Matrix (AMAT) photoreceptor belt 10 which travels sequentially through various process stations in the direction indicated by the arrow 12. Belt 10 travel is brought about by mounting the belt about a drive roller 14 and two tension rollers 16 and 18 and then rotating the drive roller 14 via a drive motor 20.

Figure 8:
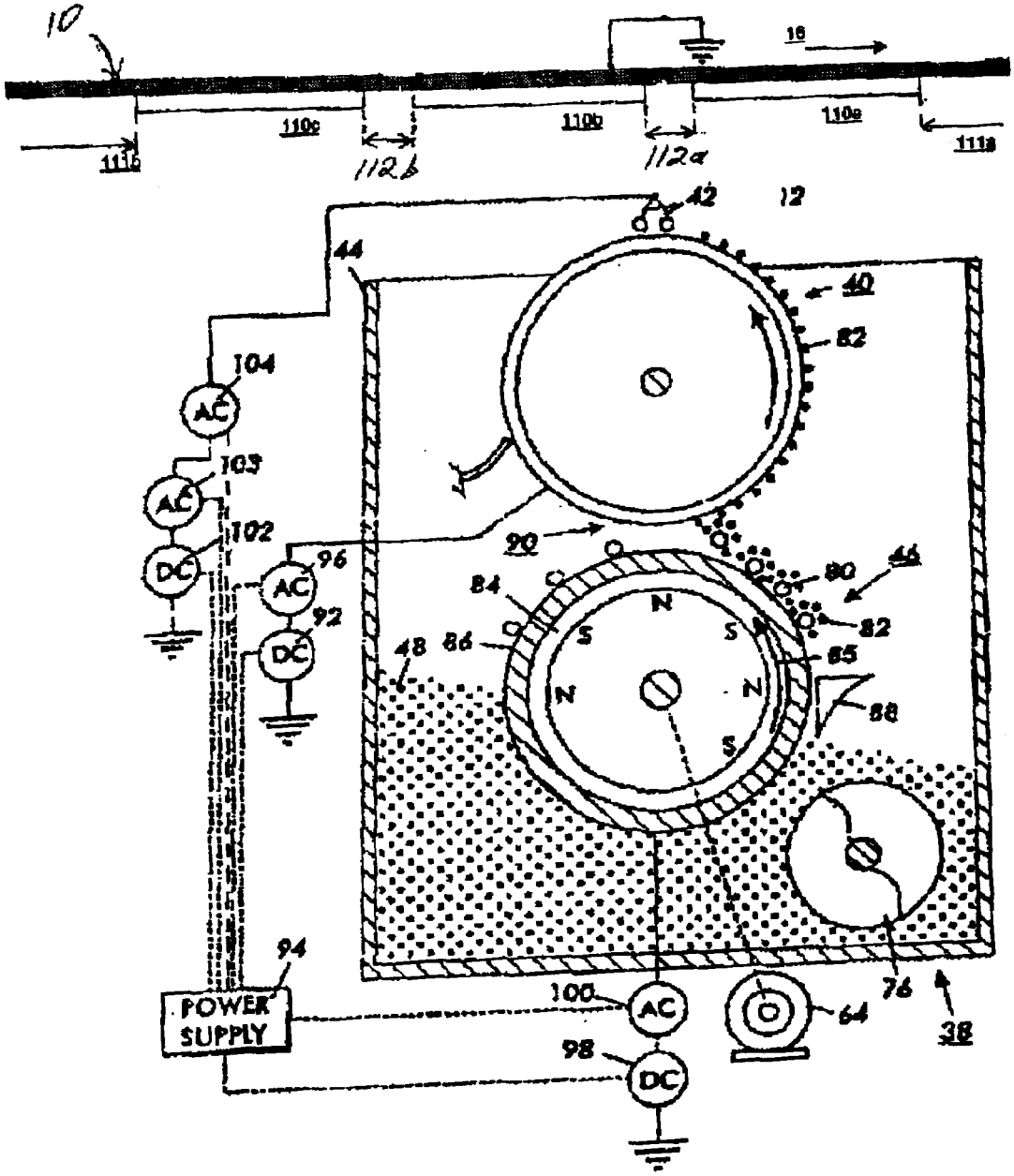
FIG. 8 is a schematic elevational view showing the development apparatus used in the FIG. 1 printing machine.

As the photoreceptor belt 10 moves, each part of it passes through each of the subsequently described process stations. For convenience of explanation, a span of the photoreceptor belt 10, contains three sections referred to as document sections 110*a*, 110*b*, 110*c*, which will be discussed in more detail (FIG. 8). The document sections 110*a*, 110*b*, 110*c* are that part of the photoreceptor belt 10 that receive the toner powder images that, after being transferred to a substrate, produce the final image. While the photoreceptor belt 10 may have numerous document sections 110*a*, 110*b*, 110*c*, each document section is processed in the same way, a description of the typical processing of one document section 110*a* suffices to fully explain the operation of the printing machine. The document sections 110*a*, 110*b*, 110*c* are separated by interdocument or inter-image regions or areas 112*a*, 112*b* that will be explained here below FIGS. 8, 9, and 10. Note that since the belt 10 rotates continuously the number of consecutive document sections 110*a*, 110*b*, 100*c* and interdocument areas 112*a*, 112*b* are unlimited and not constrained by the circumference of the belt (FIG. 8).

Figure 2:
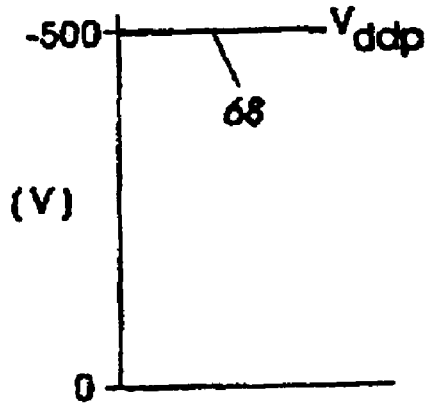
FIG. 2 shows a typical voltage profile of an image area in the electrophotographic printing machines illustrated in FIG. 1 after that image area has been charged.

As the photoreceptor belt 10 moves, the document section passes through a charging station A. At charging station A, a corona generating device, indicated generally by the reference numeral 22, charges the document section to a relatively high and substantially uniform potential. FIG. 2 illustrates a typical voltage profile 68 of a document section 110*a* after the document section 110*a* has left the charging station A. As shown, the document section 110*a* has a uniform potential of about −500 volts. In practice, this is accomplished by charging the document section 110*a* slightly more negative than −500 volts so that any resulting dark decay reduces the voltage to the desired −500 volts. While FIG. 2 shows the document section 110*a* as being negatively charged, it could be positively charged if the charge levels and polarities of the toners, recharging devices, photoreceptor, and other relevant regions or devices are appropriately changed.

Figure 3:
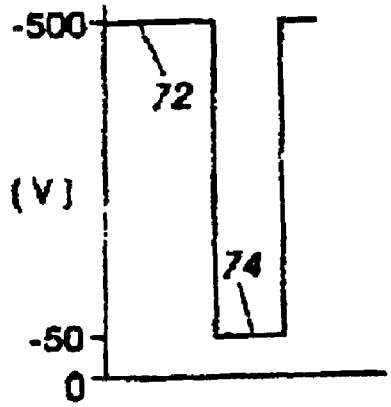
FIG. 3 shows a typical voltage profile of the image area after being exposed.

After passing through the charging station A, the now charged document section 110*a* passes through a first exposure station B. At exposure station B, the charged document section 110*a* is exposed to light which illuminates the document section 110*a* with a light representation of a first color (say black) image. That light representation discharges some parts of the document section 110*a* so as to create electrostatic latent images or image areas (not shown) within the document sections 110*a*, 110*b*, 110*c* (FIG. 8). While the illustrated embodiment uses a laser-based output scanning device 24 as a light source, it is to be understood that other light sources, for example an LED printbar, can also be used with the principles of the present invention. FIG. 3 shows typical voltage levels, the levels, 72 and 74, which might exist, on the document section 110*a* after exposure. The voltage level 72, about −500 volts, exists on those parts of the document section 110*a*, which were not illuminated, while the voltage level 74, about −50 volts, exists on those parts which were illuminated. Thus after exposure, the document section 110*a* has a voltage profile comprised of relative high and low voltages.

After passing through the first exposure station B, the now exposed document section 110*a* passes through a first development station C which is identical in structure with development system E, G, and I. The first development station C deposits a first color, say black, of negatively charged toner 31 onto the document section 110*a*. That toner is attracted to the less negative sections of the document section 110*a* and repelled by the more negative sections. The result is a first toner powder image on the document section 110*a*. It should be understood that one could also use positively charged toner if the exposed and unexposed areas of the photoreceptor are interchanged, or if the charging polarity of the photoreceptor is made positive.

For the first development station C, development system includes a donor roll 40. As illustrated in FIG. 8, electrode wires or a grid 42 is electrically biased with an AC voltage relative to the donor roll 40 for the purpose of detaching toner therefrom. This detached toner forms a toner powder cloud in the gap between the donor roll 40 and the photoconductive surface. Both electrode grid 42 and donor roll 40 are biased with DC sources 102 and 92 respectively for discharge area development (DAD). The discharged photoreceptor image attracts toner particles from the toner powder cloud to form a toner powder image thereon.

Figure 4:
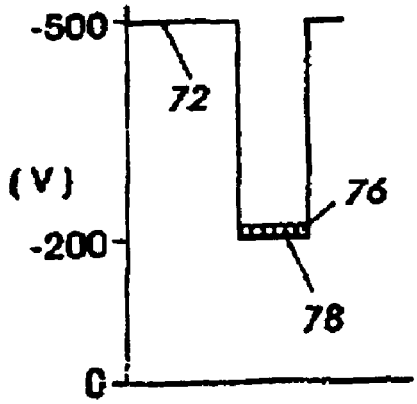
FIG. 4 shows a typical voltage profile of the image area after being developed.

FIG. 4 shows the voltages on the document section 110*a* after the document section 110*a* passes through the first development station C. Toner 76 (which generally represents any color of toner) adheres to the illuminated part of the document section 110*a*. This causes the voltage in the illuminated part of the document section 110*a* to increase to, for example, about −200 volts, as represented by the solid line 78. The unilluminated parts of the document section 110*a* remain at about the level −500 volts 72.

Referring back to FIG. 1, after passing through the first development station C, the now exposed and toned image area passes to a first recharging station D. The recharging station D is comprised of two corona recharging devices, a first recharging device 36 and a second recharging device 37. These devices act together to recharge the voltage levels of both the toned and untoned parts of the document section 110*a* to a substantially uniform level. It is to be understood that power supplies are coupled to the first and second recharging devices 36 and 37, and to any grid or other voltage control surface associated therewith, so that the necessary electrical inputs are available for the recharging devices to accomplish their task.

Figure 5:
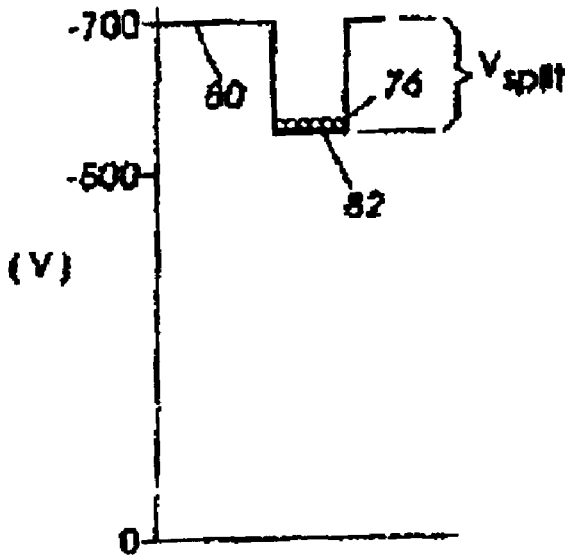
FIG. 5 shows a typical voltage profile of the image area after being recharged by a first recharging device.

FIG. 5 shows the voltages on the document section 110*a* after it passes through the first recharging device 36. The first recharging device overcharges the image area to more negative levels than that which the image area is to have when it leaves the recharging station D. For example, as shown in FIG. 5 the toned and the untoned parts of the document section 110*a*, reach a voltage level in the range of about −700 volts 80 to about −500 volts 82. The first recharging device 36 is preferably a DC scorotron.

Figure 6:
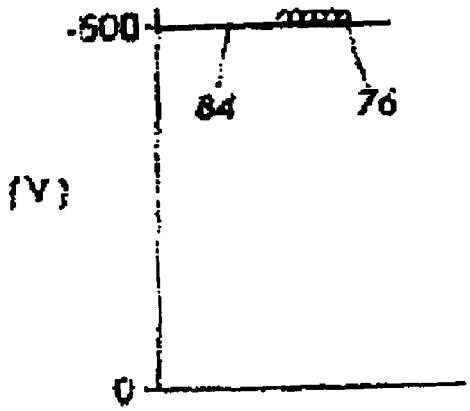
FIG. 6 shows a typical voltage profile of the image area after being recharged by a second recharging device.

After being recharged by the first recharging device 36, the document section 110*a* passes to the second recharging device 37. Referring now to FIG. 6, the second recharging device 37 reduces the voltage of the document section 110*a*, both the untoned parts and the toned parts (represented by toner 76) to a level 84 which is the desired potential of −500 volts.

Figure 7:
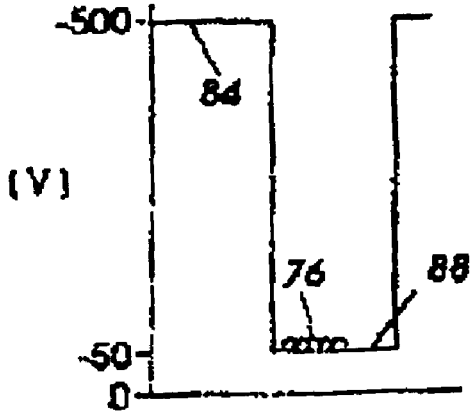
FIG. 7 shows a typical voltage profile of the image area after being exposed for a second time.

After being recharged at the first recharging station D, the now substantially uniformly charged document section 110*a* with its first toner powder image passes to a second exposure station 38. Except for the fact that the second exposure station illuminates the document section 110*a* with a light representation of a second color image (say yellow) to create a second electrostatic latent image, the second exposure station 38 is the same as the first exposure station B. FIG. 7 illustrates the potentials on the document section 110*a* after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The document section 110*a* then passes to a second development station E. Except for the fact that the second development station E contains a toner 40 which is of a different color (yellow) than the toner 31 (black) in the first development station C, the second development station is substantially the same as the first development station. Since the toner 40 is attracted to the less negative parts of the document section 110*a* and repelled by the more negative parts, after passing through the second development station E the document section 110*a* has first and second toner powder images which may overlap.

The document section 110*a* then passes to a second recharging station F. The second recharging station F has first and second recharging devices, the devices 51 and 52, respectively, which operate similar to the recharging devices 36 and 37. Briefly, the first corona recharge device 51 overcharges the document section 110*a* to a greater absolute potential than that ultimately desired (say −700 volts) and the second corona recharging device, comprised of coronodes having AC potentials, neutralizes that potential to that ultimately desired.

The now recharged document section 110*a* then passes through a third exposure station 53. Except for the fact that the third exposure station illuminates the document section 110*a* with a light representation of a third color image (say magenta) so as to create a third electrostatic latent image, the third exposure station 38 is the same as the first and second exposure stations B and 38. The third electrostatic latent image is then developed using a third color of toner 55 (magenta) contained in a third development station G.

The now recharged document section 110*a* then passes through a third recharging station H. The third recharging station includes a pair of corona recharge devices 61 and 62 that adjust the voltage level of both the toned and untoned parts of the document section 110*a* to a substantially uniform level in a manner similar to the corona recharging devices 36 and 37 and recharging devices 51 and 52.

After passing through the third recharging station the now recharged document section 110*a* then passes through a fourth exposure station 63. Except for the fact that the fourth exposure station illuminates the document section 110*a* with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner 65 (cyan) contained in a fourth development station I.

To condition the toner for effective transfer to a substrate, the document section 110*a* then passes to a pretransfer corotron member 50 which delivers corona charge to ensure that the toner particles are of the required charge level so as to ensure proper subsequent transfer.

After passing the corotron member 50, the four toner powder images are transferred from the document section 110*a* onto a support sheet 57 at transfer station J. It is to be understood that the support sheet is advanced to the transfer station in the direction 58 by a conventional sheet feeding apparatus which is not shown. The transfer station J includes a transfer corona device 54, which sprays positive ions onto the backside of sheet 57. This causes the negatively charged toner powder images to move onto the support sheet 57. The transfer station J also includes a detack corona device 56 which facilitates the removal of the support sheet 57 from the printing machine.

After transfer, the support sheet 57 moves onto a conveyor (not shown) which advances that sheet to a fusing station K. The fusing station K includes a fuser assembly, indicated generally by the reference numeral 60, which permanently affixes the transferred powder image to the support sheet 57. Preferably, the fuser assembly 60 includes a heated fuser roller 67 and a backup or pressure roller 64. When the support sheet 57 passes between the fuser roller 67 and the backup roller 64 the toner powder is permanently affixed to the sheet support 57. After fusing, a chute, not shown, guides the support sheets 57 to a catch tray, also not shown, for removal by an operator.

After the support sheet 57 has separated from the photoreceptor belt 10, residual toner particles on the document section 110*a* are removed at cleaning station L via a cleaning brush contained in a housing 66. The document section 110*a* is then ready to begin a new marking cycle.

The various machine functions described above are generally managed and regulated by a controller which provides electrical command signals for controlling the operations described above.

Referring now to FIG. 8 in greater detail, development system 38 includes a donor roll 40 that may be considered a donor member. The donor member is shown as a roll, but may be any other suitable structure or member suited for transporting toner 82 to the development zone. The development system 38 advances developing material into development zone. The development system or development unit 38 is scavengeless. By scavengeless it is meant that the developing material or toner 82 of system 38 do not interact with an image already formed on the image receiver. Thus, the system 38 is also known as a non-interactive development system. The donor roll 40 conveys a toner layer to the development zone, which is the area between the photoreceptor belt 10 and the donor roll 40. The toner layer 82 can be formed on the donor roll 40 by either a two-component developer (i.e. toner and carrier 82), as shown in FIG. 8, or a single component developer deposited on member 40 via a combination single-component toner metering and charging device. The development zone contains an AC biased electrode structure 42 self-spaced from the donor roll 40 by the toner layer. The single-component toner, developing material, or marking particles 82 may comprise positively or negatively charged toner. The electrode structure or terminal 42 may be coated with TEFLON-S (trademark of E. I. DuPont De Nemours) loaded with carbon black.

For donor roll 40 loading with two-component developer, a conventional magnetic brush 46 is used for depositing the toner layer 82 onto the donor roll 40. The magnetic brush includes a magnetic core enclosed by a sleeve 86.

With continued reference to FIG. 8, auger 76, is located in housing 44. Auger 76 is mounted rotatably to mix and transport developing material 48. The augers have blades extending spirally outwardly from a shaft. The blades are designed to advance the developing material 48 in the axial direction substantially parallel to the longitudinal axis of the shaft. The developer-metering device is designated 88. As successive electrostatic latent images 110*a*, 110*b*, 110*c* are developed; the toner particles 82 within the developing material are depleted. A toner dispenser (not shown) stores a supply of toner particles 82. The toner dispenser is in communication with housing 44. As the concentration of toner particles in the developer material 48 is decreased, fresh toner particles are furnished to the developer material 48 in the chamber from the toner dispenser. The augers in the chamber of the housing mix the fresh toner particles with the remaining developer material so that the resultant developer material therein is substantially uniform with the concentration of toner particles being optimized. In this manner, a substantially constant amount of toner particles are maintained in the chamber of the developer housing 44.

In the preferred embodiment shown in FIG. 8, the electrode structure 42 may be comprised of one or more thin (i.e. 50 to 100 microns diameter) conductive wires which are lightly positioned against the toner 82 on the donor roll 40. Although the electrode 42 is shown as conductive wires, it could encompass plates, supplemental or ancillary wires or any other electrical elements or members as one skilled in the art could devise. The distance between the wires and the donor roll 40 is self-spaced by the thickness of the toner layer, which is approximately 25 microns. End blocks (not shown) support the extremities of the wires at points slightly above a tangent to the donor roll 40 surface. A suitable scavengeless development system for incorporation in the present invention is disclosed in U.S. Pat. No. 4,868,600 and is incorporated herein by reference. As disclosed in the '600 patent, a scavengeless development system may be conditioned to selectively develop one or the other of the two document section 110*a* (i.e. discharged and charged document section 110*a*) by the application of appropriate AC and DC voltage biases to the wires 42 and the donor roll 40.

According to the present invention, and referring again to FIG. 8, the developer unit preferably includes a DC voltage source 102 to provide proper bias to the wires 42 relative to the donor roller 40. The wires 42 receive AC voltages from sources 103 and 104. These sources may generate different frequencies, and the resultant voltage on the wire 42 is the instantaneous sum of the AC sources 103 and 104 plus the DC source 102. AC source 103 is often chosen to have the same frequency, magnitude, and phase as AC source 96, which supplies the donor roll 40. Then, the voltage of the wires 42 with respect to the donor roll 40 is just the AC source 104 plus the difference or offset between the two DC sources 102 and 92. The DC voltage source 102 may be separate from the DC voltage sources 92 and 98 as shown in FIG. 8 or share a common voltage source. Further, the AC voltage source 104 may be separate from the AC voltage sources 96, 103, and 100 as shown in FIG. 8 or share a common voltage source.

The electrical sections of FIG. 8 are schematic in nature. Those skilled in the art of electronic circuits will realize there are many possible ways to connect AC and DC voltage sources to achieve the desired voltages on electrodes 42, donor roll 40, and magnetic brush roll 46.

Scavengeless developer systems such as shown in FIG. 8 exhibit an image quality defect known as "wire history". In this defect either toner or some other particulate or component of the developer material 48 is non-uniformly attached to the electrodes 42. The attachment of this material to the electrodes decreases the developability characteristics of the development system electrodes. If this attachment is non-uniform along the axial length of the development system then the developability performance of the development system along its axial length will be non-uniform and this will cause an undesired image quality defect.

To first order, the effects of the DC bias components of the electrode 42 and donor 40 can be understood best by convolving the bias sources as the difference (102 minus 92). Then the DC effects on the developability of toner to the photoconductor in the intentional image areas, e.g. 74, by the difference (102–92) and in the unintended "background" areas 72 by the donor bias 92, where the difference voltage (102–92) of a magnitude more toward the toner polarity with inhibit toner development in the intended areas and a donor bias 92 magnitude more toward the toner polarity will encourage toner development in the unintended areas.

Figure 9:
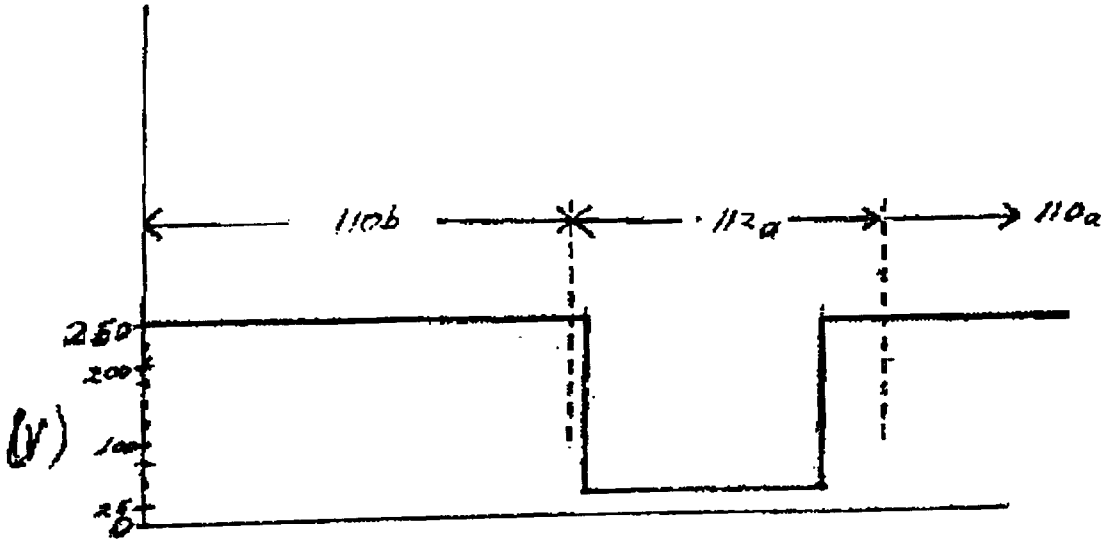
FIG. 9 shows a voltage profile of the electrode.
Figure 10:
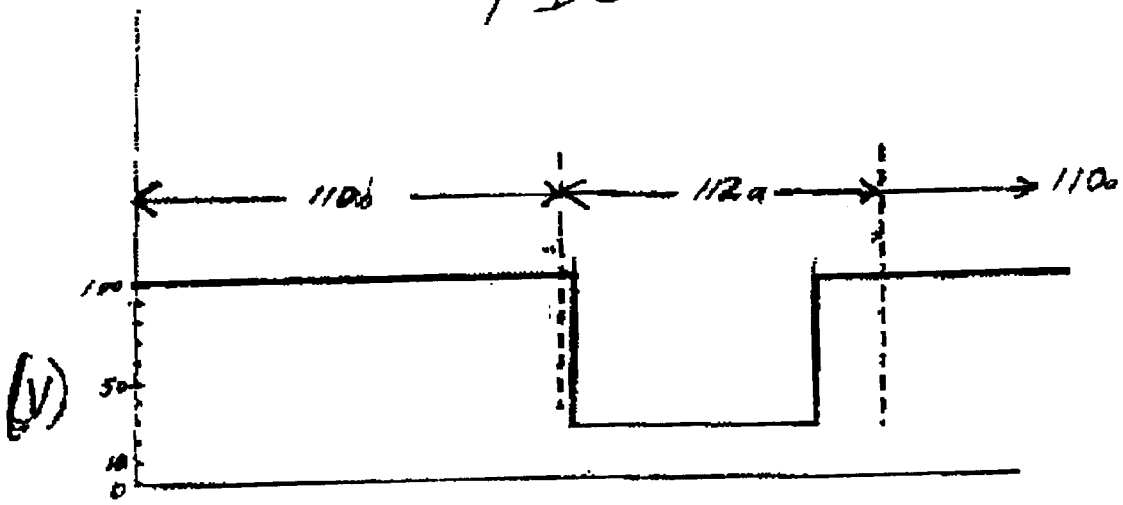
FIG. 10 shows a voltage profile of the donor member.

It has been found that the "wire history" may be reduced by applying a shifting of the electrode or wire DC bias 102 relative to the donor DC bias 92 (i.e. 102–92) to a value more toward the polarity of the toner (e.g. more negative in our example). Additionally it has been found that shifting the donor DC bias 92 to a voltage more toward the polarity of the toner will also reduce wire history. Combining these two effects has been found to be the most effective method of reducing wire history defects. However it can be seen that whereas these two shifts result in improved wire history performance they tend to reduce intended toner development and increase unintended toner development. Accordingly the resolution of this is to provide for the wire and donor bias shifts only during otherwise unused interdocument zones or 112*a*, 112*b* (inter-imaging areas or inter-imaging zones) on the photoreceptor belt 10 without any loss in overall developability (FIGS. 8, 9, 10). This shift of voltage optimizes wire conditions for developability during document sections 110*a*, 110*b*, 110*c* while allowing the unused interdocument areas 112*a*, 112*b* to utilize a donor roll 40 and wire development electrical bias, perhaps even to the point of developing some toner 82 in the interdocument areas 112*a*, 112*b*. Note that some printing machines utilize certain of the interdocument zones to print test patches for control of various process elements or for other purposes. The described bias shifts would only be applied in the otherwise unused interdocument zones.

An explanation of how wire history can be reduced or eliminated can be found by focusing on the photoreceptor belt 10 as it travels past or through the development zone in FIG. 8. FIG. 8 shows the areas on the belt 10 where the electrical bias shift is performed. As discussed above, as the photoreceptor belt 10 moves, the charged document section 110*a*, 110*b*, 110*c* through the development zone in the direction indicated 16 and the charged toner particles 82 are attached to the voltage regions 74, 88, etc. within the image areas 110*a*, 110*b*, 110*c*. Next, the interdocument areas 112*a*, 112*b* pass through the development zone.

Specifically, while the unused interdocument area 112*a*, 112*b* is in the development zone the following events occur:

The power supply controller 94 supplies a DC component of an electrical bias through DC source 102 to the electrode 42. This supply of power provides a burst of voltage that shifts the electrical bias of the electrode 42 during the passing of the unused interdocument area 112*a*, 112*b* on the photoreceptor belt 10 so as to reduce the accumulation of wire history forming particles on the electrode 42. The electrical bias shift of the electrode 42 is relative to nominal in the D.C. component of the electrical bias of the donor roll 40 as maintained by the donor roll 40 during the imaging document section 110*a*, 110*b*, 110*c*. During this instance the donor roll 40 is covered with toner 82. The electrical bias shift of the electrode 42 has a polarity equal the polarity of the developing toner material 82. Also, during the passing of the interdocument areas 112*a*, 112*b* the toner 82 remains on the donor roll 40.

FIG. 8 shows the areas on the belt 10 including the portions of the interdocument areas 112*a*, 112*b* where the electrical bias shift is produced. FIG. 9 is a graph that illustrates a preferred electrical bias shift during the passage of part of the interdocument area 112*a*, 112*b* of the belt 10 past the electrode 42. To shift the electrical bias of the electrode 42, a variety of voltages and sources may be used. As illustrated in FIG. 9, the DC 102 component of the electrical bias of the electrode 42 is shifted between about 25 volts and about 250 volts.

Wire history may also be reduced from the electrode 42 by an electrical bias shift of the donor roll 40 while the unused interdocument areas 112*a*, 112*b* are in the development zone.

Again FIG. 8 is useful to illustrate the areas and timing of the donor roll 40 electrical bias shift. During the passage of the document section 110*a* on the belt 10 through the development zone the voltage is supplied to the donor roll 40 from the AC 96 and DC 92 components, as discussed before, so that toner 82 is deposited directly on the belt 10 document section 110*a*. First, the document section 110*a* passes through the development zone, second the unused interdocument zone 112*a* passes into the development zone.

During the time the unused interdocument area 112*a* passes into the development zone a shift of voltage is sent from the DC voltage source 92 to provide a shift in the DC component of the electrical bias of donor roll 40. The electrical bias shift of the donor roll 40 is offset relative to the electrical potential of the photoreceptor belt 10. The preferred polarity shift for the donor roll 40, during the passage of the unused interdocument zone 112*a*, 112*b* through the development zone, is one that would attract toner 82 to the photoreceptor belt 10.

A variety of voltages and sources may be used to shift the electrical bias of the donor roll 40. FIG. 10 is a graph that illustrates a preferred voltage shift in the electrical bias of the donor roll 40. Specifically, FIG. 10 shows a shift in the DC component of the electrical bias of between about 25 volts and about 100 volts.

As can be realized from FIGS. 9 and 10 both the electrical bias of the electrode 42 and the electrical bias of the donor roll 40 are shifted basically simultaneously during the passage of the unused interdocument areas 112*a*, 112*b* through the development zone.

Although, any combination of polarities and voltage sources may be used with the electrode 42 and the donor roll 40, the preferred polarities, being the polarities that make the toner move in the directions described above, are as follows: the polarity of the electrical bias of the electrode 42 is equal to the polarity of the toner 82 and would repel toner 82 from the electrode; and the polarity of the electrical bias shift of the donor roll 40 is arranged with a polarity or charge that would repel toner 82 from the donor roll and attract it to the belt 10.

In the alternative embodiments, the bias shift in the electrode 42 may be performed independent from a shift in bias of the donor roll 40. For example, the bias shift of the electrode 42 may be performed prior to commencing the bias shift of the donor roll 40. In other embodiments the bias shift of the donor roll 40 may be performed prior to the bias shift of the electrode 42.

The electrical bias shifts of the electrode 42 and the donor roll 40 may be performed in an alternating sequence during the passage of the unused interdocument zones 112*a*, 112*b*. Also, the electrical bias shifts of the electrode 42 and the donor roll 40 may be alternated or interspersed with the preferred embodiment of electrically biasing both the donor roll 40 and the electrode 42.

In conclusion, this invention provides a successful way of reducing or eliminating significant wire history. To reduce wire history, electrical bias shifts in the form of a burst mode are applied during the unused interdocument zones 112*a*, 112*b* so that there is no loss in developability in the document sections 110*a*, 110*b*, 110*c*. First, the DC component of the electrical bias on the electrode 42 may be shifted relative to the electrical bias on the donor roll 40. Next, the DC component of the electrical bias on the donor roll 40 may be shifted relative to the electrical bias on the photoreceptor belt 10. Also, the DC component of the electrical bias of both the electrode 42 and the donor roll 40 may be shifted. Any of these techniques keeps the electrode cleaner and enhances the robustness of the developer unit. The present invention as described above protects the developer unit from mechanical, electrical and moisture degradation, therefore, extends the dependability and durability of the developer unit.

It should be understood that the foregoing description is only illustrative of the invention. Various alternatives and modifications can be devised by those skilled in the art without departing from the invention. For example, in place of the photoreceptor belt 10, the present invention may be used on an imaging apparatus having a photoreceptor drum or any other type of desired electrostatically charged receiver. Accordingly, the present invention is intended to embrace all such alternatives, modifications and variances that fall within the scope of the appended claims.

We claim:

1. A image transfer apparatus, comprising:

a development unit having a development zone;

a donor member for transporting marking particles to the development zone adjacent an imaging member, the imaging member, having image receiving regions and inter-image areas between the image receiving regions, the imaging member advancing the image receiving regions and the inter-image areas into and out of the development zone; and a voltage supply to electrically bias the donor member relative to the imaging member, the voltage supply generating an electrical bias shift in the donor member from a first electrical bias to a second electrical bias, the electrical bias shift being generated, during the advancement of the inter-image area through the development zone, wherein an electrode in the development zone is cleaned.

2. The apparatus according to claim 1, wherein the imaging member is at least one of a belt or a drum.

3. The apparatus according to claim 1, wherein the electrical bias shift of the donor member has a polarity that causes the marking particles to be attracted to the imaging member.

4. The apparatus according to claim 1, wherein a direct current component of the electrical bias of the donor member is shifted between about 25 volts and about 100 volts.

5. The image transfer apparatus, according to claim 3, wherein said bias is shifted to repel development particles from the donor member towards the imaging member.

6. An image transfer apparatus, comprising:

a development unit having a development zone;

a donor member for transporting toner to the development zone adjacent a moveable photoreceptor member, the moveable photoreceptor member holding electrostatic latent image regions and inter-image areas between the electrostatic latent image regions and moving the electrostatic latent image regions and inter-image areas into and out of the development zone;

an electrode positioned in the development zone for transferring of the toner between the donor member and the moveable photoreceptor member;

a first voltage supply for providing a direct current component of an electrical bias of the donor member, the direct current component of the electrical bias is shifted relative to the moveable photoreceptor member during the movement of the inter-image area through the development zone; and a second voltage supply for providing a direct current component of an electrical bias of the electrode, the direct current component of the electrical bias of the electrode is shifted relative to a nominal electrical bias on the donor member during the movement of the inter-image area through the development zone, wherein the electrode is cleaned.

7. The apparatus according to claim 5, wherein the moveable photoreceptor member is at least one of a belt or a drum.

8. The apparatus according to claim 5, wherein a polarity shift of the electrically biased electrode is equal to a toner polarity.

9. The apparatus according to claim 5, wherein the direct current component of the electrically biased electrode is shifted between about 25 volts and about 100 volts.

10. The apparatus according to claim 5, wherein the electrical bias of the donor member has a polarity that attracts toner to the moveable photoreceptor member.

11. The apparatus according to claim 5, wherein the direct current component of the electrical bias of the donor member is shifted between about 25 volts and about 100 volts.

12. The apparatus according to claim 5, wherein the electrical bias shift of the donor member and the electrode occurs substantially in unison.

13. The apparatus according to claim 5, wherein the electrical bias shift of the donor member and the electrode occurs sequentially.

14. A method of transferring an image, comprising the steps of:

generating image regions on an image receiving member, the image regions being separated by inter-image areas;

transporting marking particles with a development member to a development zone having an electrode positioned between the image receiving member and the development member;

supplying voltage for electrically biasing the development member relative to the image receiving member; and varying at least a direct current component of the electrical bias of the development member to shift at least the direct current component from an initial voltage to another voltage during passage of the inter-image areas through the development zone.

15. The method according to claim 14, wherein the image receiving member is at least one of a drum or a belt.

16. The method according to claim 14, wherein supplying voltage provides electrical bias of the development member with a polarity that attracts marking particles to the image receiving member.

17. The method according to claim 14, wherein the shift in electrical bias is between about 25 volts and about 100 volts.

18. The method according to claim 14, wherein said bias is shifted to repel development particles from said development member to the imaging receiving member.

19. A method of transferring an image, comprising the steps of:

producing electrostatic latent images in regions on a moveable photoreceptor belt, the electrostatic latent image regions on the moveable photoreceptor belt being separated by inter-image areas on the moveable photoreceptor belt;

transporting toner to a development zone having an electrode positioned between the moveable photoreceptor belt and a donor member;

supplying a first voltage for an electrical bias shift of the donor member relative to the moveable photoreceptor belt within the inter-image areas of the moveable photoreceptor belt; and supplying a second voltage for an electrical bias shift of the electrode relative to a nominal electrical bias on the donor member, the electrical bias of the electrode being shifted wherein the electrode is cleaned.

20. The method according to claim 19, wherein supplying first voltage includes:

providing the donor member with a polarity that attracts toner to the moveable photoreceptor belt.

21. The method according to claim 19, wherein supplying second voltage includes:

providing the electrode with a polarity equal to a toner polarity.

22. The method according to claim 19, wherein supplying a first voltage includes:

shifting the electrical bias of the donor member between about 25 volts and about 100 volts.

23. The method according to claim 19, wherein supplying a second voltage includes:

shifting the electrical bias of the electrode between about 25 volts and about 250 volts.

24. The method according to claim 19, wherein the electrical bias shift of the donor member and the electrode occurs substantially in unison.

25. The method according to claim 19, wherein the electrical bias shift of the donor member and the electrode occurs sequentially.

* * * * *